United States Patent [19]

Cooper

[11] Patent Number: 4,623,065

[45] Date of Patent: Nov. 18, 1986

[54] SHELVING SUPPORT STRUCTURE

[76] Inventor: James W. Cooper, Rte. 2, Box 229, Pegram, Tenn. 37143

[21] Appl. No.: 722,005

[22] Filed: Apr. 11, 1985

[51] Int. Cl.[4] ..... A47F 43/00

[52] U.S. Cl. ..... 211/187; 108/108; 248/243

[58] Field of Search ..... 211/187, 190, 189; 108/108, 107; 248/243, 242, 241

[56] References Cited

U.S. PATENT DOCUMENTS

| | | | |
|---|---|---|---|
| 2,723,893 | 11/1955 | Gross | 248/243 X |
| 2,965,242 | 12/1960 | Grotke | 211/190 |
| 2,971,805 | 2/1961 | Weiss | 248/243 X |
| 3,101,681 | 8/1963 | Streater | 211/187 X |
| 3,200,775 | 8/1965 | Peters | 108/108 |
| 3,316,863 | 5/1967 | Zock | 248/243 X |
| 3,394,507 | 7/1968 | Doke | 108/107 X |
| 4,204,480 | 5/1980 | Hanna | 211/187 X |
| 4,526,110 | 7/1985 | Franz | 108/108 |

*Primary Examiner*—J. Franklin Foss
*Assistant Examiner*—Sarah A. Lechok Eley
*Attorney, Agent, or Firm*—Pitts and Brittian

[57] ABSTRACT

A demountable system for the display of merchandise such as books, magazines, newspapers and the like. This system employs a top cap and contoured upright struts having an appropriate contour to orient shelving at different angles to the vertical from a upper most position on the strut to a lower most position. The system is easily installed or disassemblied at a particular place of business. The principal feature involves providing an open channel in the rear surface of each strut to releasably accept the edge of a spacer panel contoured to the desired configuration of the strut. In this way, the strut is always maintained in the proper configuration without the mechanical attachments of spacers and the like as previously employed. One end of each of the struts is received within a top cap and a further end engages the floor to maintain each strut in proper orientation without physical fasteners. Each strut is provided with edge recesses or grooves to accept back panels to complete the attractive feature of the shelving units. Also, each strut releasably receives an apertured face plate for the attachment of shelving units. The resultant structure is quickly and easily assemblied or disassemblied with a substantial savings in time.

11 Claims, 8 Drawing Figures

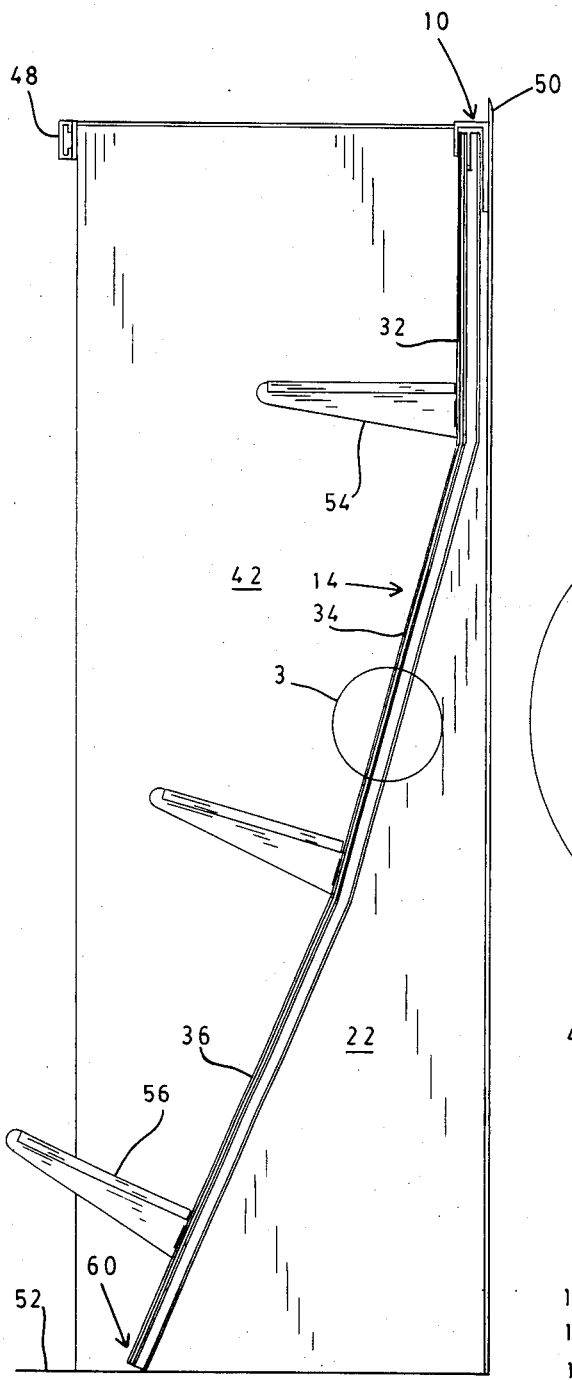
Fig. 2
Fig. 3
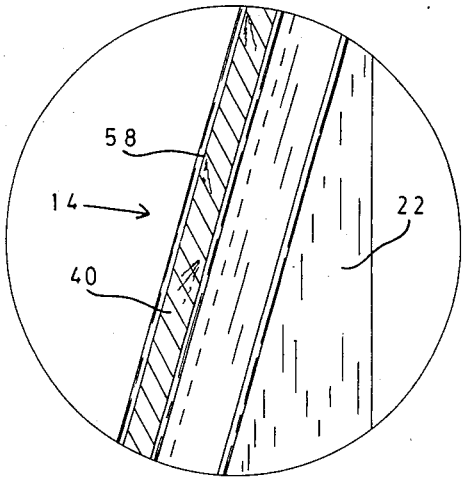
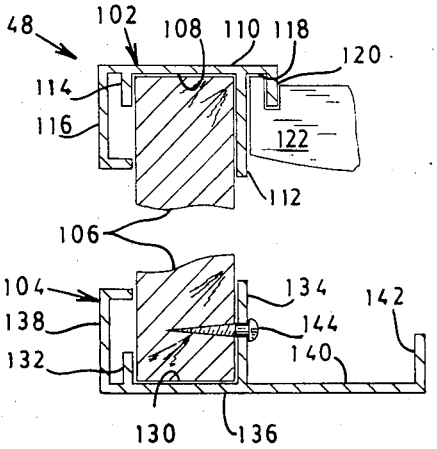
Fig. 8

SHELVING SUPPORT STRUCTURE

DESCRIPTION

1. Technical Field

This invention relates to an improved merchandise display assembly, and more particularly to a shelving support structure of the type utilized for the display of magazines, books and the like.

2. Background Art

A variety of shelving assemblies for installation in many types of retail stores are known and used. The structures generally include various types of vertically aligned rail members, sometimes referred to as upright struts, attached to a support wall, in which are provided apertures for the receipt of the hook portion of a variety of types of shelves or shelf brackets. Sometimes these shelves include the shelve support and in other instances, the shelve support is a separate item from the shelving itself. Typical of the structures known in the art are shown and described in U.S. Pat. Nos. 3,601,347, issued to J. W. Attwood on Aug. 24, 1971; 4,046,083, issued to R. N. Murdoch, et al., on Sept. 6, 1977; 4,204,480, issued to J. L. Hanna on May 27, 1980; and 4,411,400, issued to L. E. Everette on Oct. 25, 1983.

Structures for the display of magazines, newspapers, books, and the like, differ from those utilized in the display of other types of merchandise such as food products. It has been found, for example, that when literature type products are to be displayed, it is desirable that the lower shelves of a display structure project forward more closely to the viewer than the upper shelves. Furthermore, it has been found that if the lower shelves of a unit are disposed at an angle with respect to upper shelves such that the material can be more easily viewed, such literature merchandise is more readily observed by a potential purchaser.

In order to accommodate such viewing, special types of shelve support structures have been devised whereby lower shelves do, in fact, project at a different angle than those upper shelves of the same structure. This has been accomplished by forming the upright struts into a desired configuration and permanantly attaching these struts to a spacer which projects rearwardly to a wall or other structure such that the curvature or shaping is maintained throughout the use of the shelving unit. Typically the struts are of right angle construction with the spacer bolted or riveted to one leg. Since the tilt angle may differ from one installation to another, or at least the desirable presentation of material may differ from one installation to another, the time and cost of assembling, or disassembling, such display for differing applications units become substantial. For example, the installation of shelving in a new store for the sale of books may necessitate a period of up to three weeks for the fabrication and installation of display units using prior art construction. Typically, these units are of the order of seven feet in height and extend along a majority of the walls of the store.

Accordingly, it is one object of the present invention to provide a shelving system or structure wherein the angle of the shelves, with respect to the vertical, can be changed between the upper portion of the structure and the lower portion.

It is another object of the present invention to provide a shelving structure wherein a selected range of angular relationship of shelving can be selected for a particular installation without substantially affecting the cost of such installation.

It is still another object of the present invention to substantially reduce the cost of installing shelving units in a retail facility wherein literature type products are to be displayed and sold.

These and other objects of the present invention will become apparent to one versed in the art upon a consideration of the drawings described hereinafter, together with a description with respect to those drawings.

DISCLOSURE OF THE INVENTION

In accordance with the present invention, a shelving structure is provided wherein upright struts are provided with a lengthwise groove in their rear surface to releasably accept the edge of a spacer of selected perpherial shape. The rearward edge of this spacer is intended to conform to the vertical surface of a wall or like structure, with the forward edge of the spacer having the proper conformity to shape the upright strut to achieve the desired orientation of any shelving unit releasably attached thereto. In the preferred embodiments of the invention, these upright struts are also provided with edge grooves to accept panels to form the backing of the combined shelving unit as well as a channel to accept removable standards having apertures selected for size and spacing to match a particular brand of shelving units. Furthermore, to complete the entire structure, a top cap is provided to releasably hold the upright struts so as to form the entire shelving structure.

BRIEF DESCRIPTION OF THE DRAWINGS

FIG. 2 is a cross-sectional view of the structure shown in FIG. 1 taken at 2—2 of FIG. 1.

FIG. 3 is a cross-sectional enlargement of that portion identified at 3 in FIG. 2.

FIG. 8 is a cross-sectional drawing of a cornice unit for use as a portion of the shelving unit of the present invention.

BEST MODE FOR CARRYING OUT THE INVENTION

Figure 1:
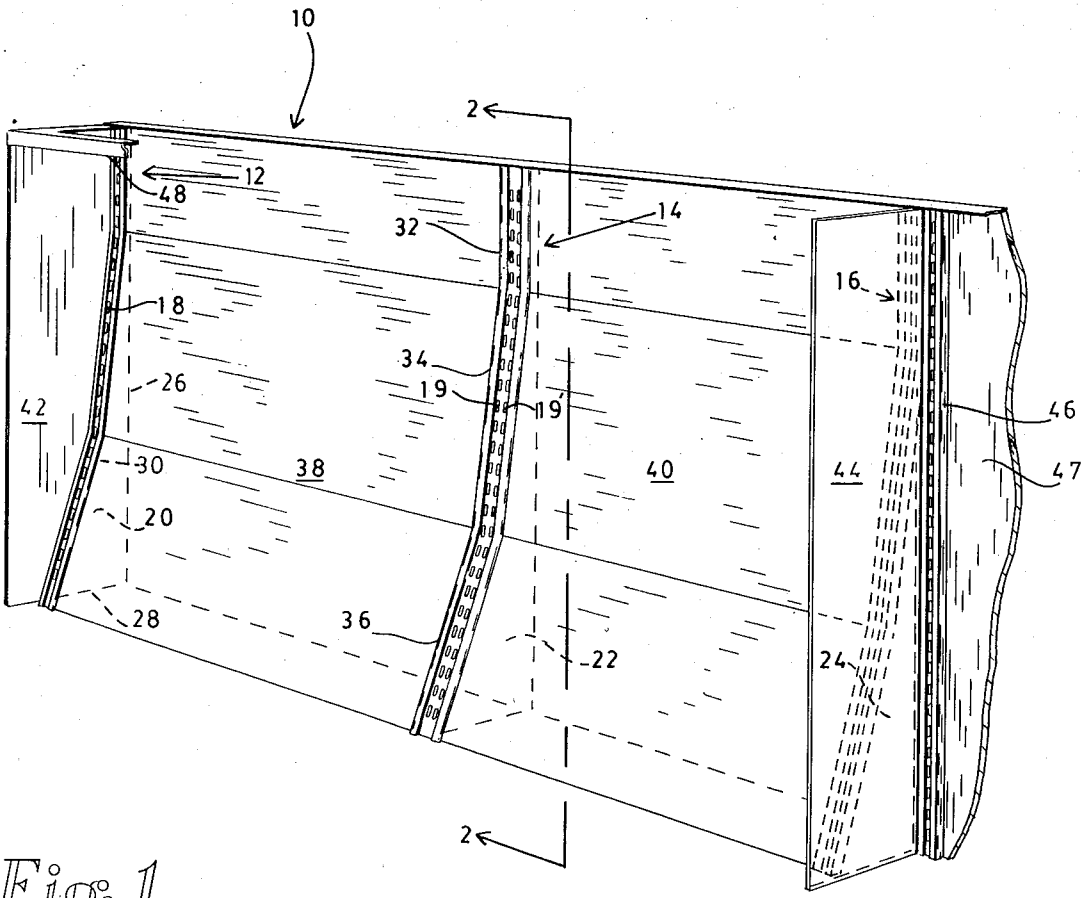
FIG. 1 is an isometric drawing of a portion of a shelving installation illustrating the present invention.
Figure 4:
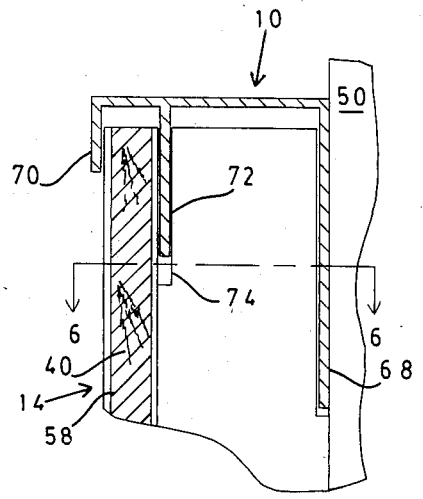
FIG. 4 is a cross-sectional drawing of a top cap for the structure shown in FIG. 2.
Figure 6:
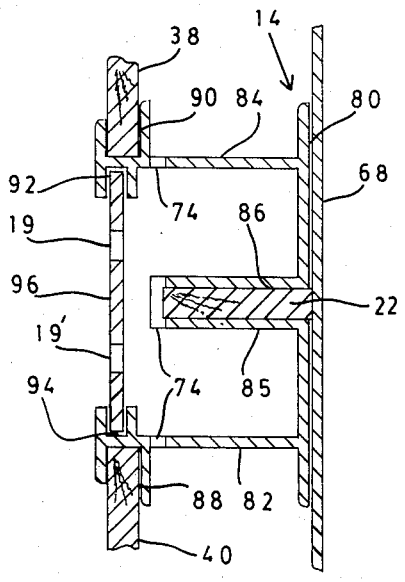
FIG. 6 is a cross-sectional drawing of the strut units of FIGS. 2 and 5 taken at 6—6 of FIG. 5.

Referring to FIG. 1, shown therein is an isometric drawing of one embodiment of a portion of a typical shelving installation employing the present invention. Typically, this system would be installed against a wall of the facility for the display of books, magazines, newspapers, and the like. Of course, other types of merchandise can be displayed thereon. Within this structure or system, there is a top cap 10, such as shown in FIG. 4, which is releasably attached to the wall by any suitable means, preferably screws (not shown). Mechanically interlocked with the top cap 10 are upright struts 12, 14, and 16 of a construction according to the present invention. Strut 12, for example, is a single strut of the type illustrated in FIG. 7 as is strut 16. Strut 14, however, is a double strut as illustrated in FIG. 6. By single is meant that there is a single row of apertures 18 to accept hooks of conventional shelving units (not shown). The double unit has a pair of parallel rows of apertures 19, 19′ provided for similar purposes. A spacer unit is positioned behind each of the struts 12, 14, and 16 such as 20, 22, and 24. These spacers have a configuration along the rear edge (such as 26) so as to conform to the aforementioned wall, and a bottom edge 28 to conform to the floor of the facility. A front edge, such as 30, of each of the spacers is configured to provide an appropriate contour of each of the struts from top to bottom thereof to achieve a desired orientation to shelving attached to the struts at various positions along the length thereof. In this embodiment shown in FIG. 1, the configuration is such that an upper portion of each strut is parallel to the wall; an intermediate portion forms a first angle with the wall; and a second portion forms a second and greater angle with respect to the wall. These angles are shown more clearly in FIG. 2. The contour of each of the spacers 20, 22 and 24 of this particular embodiment are identical so that struts 12, 14 and 16 uniformily support shelving units (not shown) at the desired angles.

Also shown in FIG. 1 are back panels 38 and 40 to make up two portions of the shelving assembly. As will be discussed in more detail hereinafter, these back panels 38, 40 are held in the edges of the struts 12, 14, and 16 and have a curvature to match the curvature of each of the individual struts, thereby forming the back of the area to which shelving is attached. An end wall 42 is illustrated as well as a separator or intermediate end wall 44. This separator is utilized to divide a shelving assembly having a portion using curved struts from a section or sections having straight struts such as struts 46. This type of variation in sections of a shelving structure is frequently encountered. Also illustrated is a partial section of cornice 48 suspended across the top front of the shelving structure. This cornice can be supported, for example, by units (not shown) releasably engaged with tops of the struts units to maintain the proper elevation and spacing from the back panels 38, 40.

A cross-sectional view of the structure of FIG. 1 is illustrated in FIG. 2. To this cross-section has been added a designation of the wall 50 and the floor 52. In addition, a pair of shelve units 54, 56 have been added to illustrate the angular relationship of shelves positioned at various locations along the length of strut 14, for example. It may be seen that the shelve 54 provides a substantially horizontal display surface because it is attached to strut 14 at the substantially vertical portion 32. In contrast, shelve 56 is tipped upwardly, and projects outwardly, at the forward edge because it is attached to the strut 14 at a lower portion 36 that is formed at an angle to the wall 50.

Since the scale of the drawing in FIG. 2 is extremely small, a central portion indicated at 3 therein is drawn in enlarged form in FIG. 3. In this drawing it can be seen that the strut 14 is provided with an edge recess 58 into which is inserted the edge of back panel 40 illustrated in FIG. 1. It may be seen, in addition, that the spacer 22 projects backwardly toward the wall 50, downwardly to the floor 52, and forwardly to be received in the back of the strut 14 as will be described in connection with FIG. 6.

The drawing shown in FIG. 4 illustrates the interlocking feature between the top cap 10 and a typical strut 14. The top cap is provided with a rearward flange 68 with sufficient area to releasably attach the same to a wall 50 with any suitable means such as screws and the like. Furthermore, the top cap 10 is provided with a forward lip 70 and an intermediate flange 72. A slot 74 is provided across the top of each strut, such as strut 14, with this slot 74 adapted to receive the aforementioned intermediate flange 72. Through this arrangement, as also illustrated in connection with FIG. 6, each strut is releasably held by the top cap 10 in its appropriate position. As indicated previously, the edge of the strut 14 is provided with a groove or slot 58 into which the back panel 40 is inserted (see FIG. 1 and FIG. 3).

Figure 5:
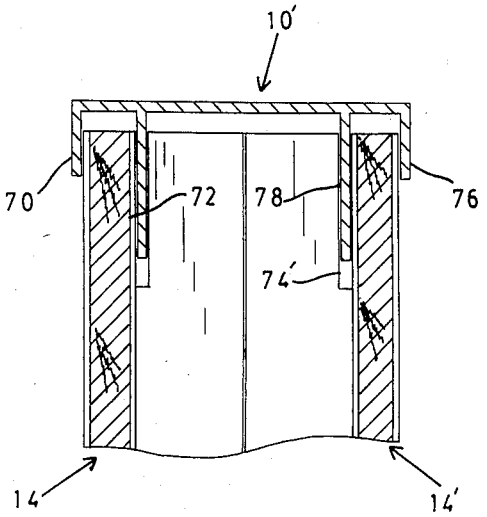
FIG. 5 is a cross-sectional drawing of a top cap useful for island type shelving units, having similar structures to the top cap of FIG. 5 symmetrically placed back-to-back.

Referring now to FIG. 5, shown therein is a top cap 10′ useful when shelving units are positioned back-to-back as in an island. One-half of the unit is substantially like that shown in FIG. 4, and the equivalent components are shown using the same numerals. Since there is to be no attachment to a wall, the flange used in FIG. 4 is not needed in this embodiment. In addition, there is a lip 76 projecting in an opposite direction to lip 70 and an intermediate flange 78 positioned in a mirror-like fashion to flange 72 to make a symmetrical unit. This modified top cap is designed to accept strut 14 as well as 14′ on the reverse side. Strut 14′ is provided with a slot 74′ to assist in properly locating this strut with respect to the top cap 10′.

The cross-sectional view shown in FIG. 6 is the view taken at 6—6 of FIG. 4. This shows a transverse cross-section of the strut 14 and illustrates most clearly several features of the present invention. Strut 14 is provided with a back plate 80 from which perpendicularly extend side walls 82 and 84. Furthermore, extending lengthwise of the strut 14 is a box-like member 85 which defines a channel or groove 86 in the back plate 80 to accept the aforementioned spacer 22 discussed in connection with FIG. 1. Each of the side walls 82, 84 is provided at its outward end with oppositely directed channels or grooves 88, 90, respectively, which grooves or channels accept the aforementioned back panels 38 and 40 as shown. Furthermore, the outward edge of the side walls 82, 84 are each provided with facing grooves or channels 92, 94, wherein a standard or bar 96 can be inserted. This standard contains the aforementioned apertures 19, 19′ which accept hooks of a shelving unit (not shown). In this figure it can be seen that the slot 74 of the top of the strut 14 extends into the side walls 82 and 84 as well as the box-like structure 85. Accordingly, angular stability is given to the strut when it is positioned in the top cap 10 as shown in FIG. 4.

Figure 7:
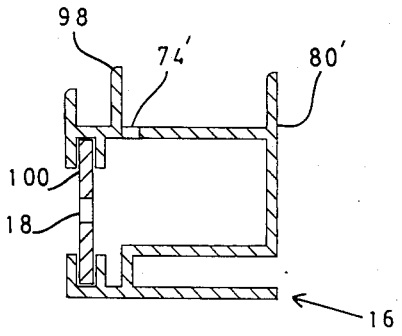
FIG. 7 is a cross-sectional drawing of a strut unit similar to that shown in FIG. 2 and identified at 16 in FIG. 1, wherein it defines the end of the subject shelving structure.

Shown in FIG. 7 is a transverse cross-sectional view of the single strut 16 illustrated in FIG. 1. As indicated in connection with that figure, certain of the struts form the end of a series of struts of a particular shelving section. Since these struts can be supported by an end wall such as 42 or 44 of FIG. 1, they do not require a channel in the rear surface to receive a spacer as does the strut 14 shown in FIG. 7. However, such slot can be provided for a spacer if desired. Furthermore, only one outwardly directed slot or channel 98 is required to accept a back panel for the shelving structure. However, a slot 74′ is required to accept the flange 72 of the top cap 10 in order to provide stability to this type of strut. As shown, a single strut receives a narrow bar 100 having a single roll of apertures 18. As in FIG. 6, this bar 100 is removable such that another bar with apertures having an appropriate size and spacing may be inserted for the particular shelving units being utilized.

A suitable cornice member 48 (see FIGS. 1 and 2) is illustrated in cross-section in FIG. 8. This cornice which extends the length of the shelving unit, includes a top member 102 and a bottom member 104 spaced apart by a cornice board 106. This construction permits the use of any selected width of cornice as well as the material for the cornice, for specific installations. The top member 102 is formed to include a U-shaped channel 108 typically formed by a top edge 110, a rear wall 112 and a front wall 114. This channel 108 closely receives a lengthwise edge of the cornice board 106. The top member 102 can be provided with a front lip 116, as shown, or the front wall 114 can function as the front lip.

The top member 102 is provided with a further channel 118 along the rearward edge thereof. This channel 118 is typically formed by the top edge 110, the rear wall 112 and a rear flange 120. This further channel 118 provides for engagement with a suitable rod or bracket 122 for support of the cornice unit 48. The opposite end (not shown) of the bracket 122 is adapted to engage the aforementioned struts of the shelving unit.

The bottom member 104 of the cornice unit 48 is substantially a mirror image of the top member 102. A U-shaped channel 130 is provided to closely receive an opposite lengthwise edge of the cornice board 106. This channel is typically formed by a front wall 132, a backwall 134 and a bottom edge 136. The bottom member also is provided with a front lip 138, although this can be a function of the front wall 132 to cover the edge of the cornice board. The bottom wall has an extension 140 terminating in a rear flange 142; this extension 140 being provided to shield any lighting means (not shown) positioned behind the cornice board 106. The bottom member 104 can be attached to the cornice board 106 by any suitable means, such as a threaded fastener 144, as shown. Corresponding fasteners (not shown) can be used to join the top member 102 to the cornice board 106.

The framework portions of the shelving structure are designed for fabrication by extrusion. This includes the top cap, the struts, and the cornice top and bottom members. Typically, they are fabricated from aluminium; however, other materials can be used. Although the dimensions are not critical, the cross sections in FIGS. 3–8 are substantially full scale of a typical structure.

In a normal utilization of the present invention, the struts to be used for a particular installation are shaped to provide a selected configuration from the top to the bottom, whereby the desired orientation of shelves will be achieved. This is usually effected by cutting a notch or slot across the back edge (e.g., 80 in FIG. 6) prior to bending. Thereafter, spacers are formed having a forward edge to conform to this selected shape within a particular facility where the display unit is to be utilized. This forming can be easily accomplished "on site" if desired. The top cap 10 is first applied to a wall using any suitable means at a selected height. This top cap is installed substantially horizontally along the wall for the desired length of the particular shelving installation. Thereafter, the preshaped struts are inserted such that the corresponding slots (typically slot 74) is engaged with the flange 72 in the top cap, and the bottom of the strut is against the floor 52. Typically (referring to FIG. 1), strut 12 is inserted and placed at its desired location. Then, spacer 22 is inserted into the rear channel 86 of strut 14 and strut 14 is generally placed in engagement with top cap 10 with the bottom end on the floor. The spacer does not have to be fastened to the strut, as in the prior art, because of the compression (top cap to floor) within the strut that maintains the contour and position. The back panel 38 is thence installed within the edge groove of strut 12 and subsequently in the groove 90 of strut 14 such that the back panel correctly spaces strut 14 along the top cap. Back panel 40 is then inserted in the channel or groove 88 of the strut 14, and a single strut unit such as strut 16 is thereafter positioned to accept the opposite edge of the back panel 40. Both back panel 38, 40 have sufficient flexibility so as to bend to conform to the angular orientations of the struts. Thereafter, appropriate end walls 42, 44 are installed and fastened by any suitable means, such as screws, to the edge of struts 12 and 16 to complete the section having shelving that is to be oriented at one angle near the top of the shelving unit and at a different angles at the lower portions of the shelving unit. Any cornice to be used, such as shown in FIG. 8, is then mounted upon appropriate rods or brackets releasably attached to the aforementioned struts, such that it is supported at a selected position at the top and forward edge of the shelving system. Although only two sections are shown having configured strut units, the shelving system may contain one or more of the units and may contain all such units throughout its length.

In FIGS. 1 and 2, each of the strut units is shown as having lengthwise sections which are angularly oriented with each other. The spacer (e.g., spacer 22) edge has a similar configuration. However, other configurations may be utilized as desired or necessary. For example, the strut may assume a curved contour from top to bottom with no specific transition between areas of different angles. If such is chosen, the edge of the spacer is appropriately shaped to fit within the channel within the back of the strut to hold the strut in this preshaped configuration.

From the foregoing, it will be recognized by one versed in the art that a shelving system has been shown and described which may be readily and quickly installed within any facility. Furthermore, the structure provides for sections wherein a selected configuration of shelves may be utilized to achieve optimum display of merchandise thereon.

Although a preferred embodiment of the present invention is illustrated and described herein, other embodiments will become apparent to one skilled in the art upon having read and understood the foregoing. Accordingly, the present invention is not limited to this embodiment but includes the equivalents of these, and the scope of the invention is thus defined in the claims.

I claim:

1. A vertical strut unit for demountable shelving assemblies adapted for supporting shelving units at varying angles between an upper portion and a lower portion along such strut unit, which comprises:

an elongated substantially hollow body member, having a first end and a further end, formed with a back plate and side plates extending substantially perpendicularly from said back plate, said back plate being provided with a U-shaped channel extending along said body member substantially parallel to and midway between said side plates, said body member formed with a selected contour between said first end and said further end to achieve such varying angles of such shelving units;

a face plate extending between said side plates spaced from said back plate a uniform distance, said face plate being provided with at least one longitudinal row of apertures along such strut unit for receiving such shelfing units; and a planar spacer unit having one edge formed with a contour complementary with said contour of said body member, said contoured edge of said spacer unit being releasably received in said channel in said back plate of said body member to maintain said contour of said body member.

2. The strut unit of claim 1 wherein said side plates are each provided with facing U-shaped channels, and said face plate is a substantially flat bar removably received in said facing channels of said side plates.

3. The strut unit of claim 1 wherein each of said side plates is provided with symmetrical oppositely directed U-shaped channels extending along such strut.

4. A demountable shelving assembly adapted for supporting shelving units at varying angles between an upper position and a lower position of such assembly, which comprises:

a top cap for substantial horizontal orientation;

at least a pair of substantially vertical struts engaged with said top cap at selected positions, each of said struts comprising an elongated substantially hollow body member having a first end adapted to engage said top cap, and a further end, said body members formed with a back plate and integral side plates extending substantially perpendicularly from said back plate, and provided with a face plate extending between said side plates spaced from said back plate a uniform distance from said back plate, said face plate provided with at least one longitudinal row of apertures for receiving such shelving units, wherein at least one of said body members is provided with a longitudinal U-shaped channel centrally disposed in said back plate along said strut, and wherein said struts are formed with a selected contour between said first end and said further end of said body member to achieve such varying angles of such shelfing units; a planar spacer unit having one edge formed with a contour complementary with said contour of said struts, said contoured edge of said spacer being releasably received in said channel in said back plate of said body member; and a panel extending between and received in said side plates of said struts for forming a back wall of such shelving assembly.

5. The assembly of claim 4 wherein said face plates of said struts are removably secured to said side plates.

6. The assembly of claim 5 wherein said side plates of said struts are provided with facing U-shaped channels, and said face plate is a substantially flat bar removably received in said facing channels of said side plates.

7. The assembly of claim 4 wherein said side plates are provided with symmetrical oppositely directed U-shaped channels, and edges of said panel are removably received in said oppositely directed channels of adjacent struts.

8. The assembly of claim 4 further including end walls attached to said struts forming ends of said assembly.

9. The assembly of claim 4 wherein each of said struts is provided with a slot in said first end of said body member substantially parallel with said back plate, and said top cap includes a longitudinal vertically oriented flange for engagement with said slot.

10. The assembly of claim 4 further comprising:

a cornice unit extending along such assembly, said cornice unit comprising, a. a top member extending along said cornice unit, said top member being provided with a U-shaped channel extending the length thereof, b. a bottom member extending along said cornice unit, said bottom member being provided with a U-shaped channel extending the length thereof oriented toward said channel of said top member, and c. a cornice board engaged with said channels of said top member and said bottom member; and a plurality of cornice supports each having a first end releasably engaged with selected of said apertures of said face plate, and a further end releasably attached to said cornice unit.

11. A demountable shelving assembly adapted for supporting shelving units at varying angles between an upper position and a lower position of such assembly, which comprises:

a top cap for substantial horizontal orientation, said top cap including a downwardly directed longitudinal flange;

at least a pair of substantially vertical struts engaged with said top cap at selected positions, each of said struts comprising an elongated substantially hollow body member having a first end and a further end, said body members formed with a back plate and integral side plates extending substantially perpendicularly from said back plate, and provided with a face plate extending between said side plates spaced from said back plate a uniform distance from said back plate, said face plate provided with at least one longitudinal row of apertures for receiving such shelving units, wherein at least one of said body members is provided with a logitudinal U-shaped channel centrally disposed in said back plate along said bodymember, and wherein said struts are formed with a selected contour between said first end and said further end to achieve such varying angles of such shelfing units, and said first end of each body member is provided with a slot substantially parallel with said back plate for engagement with said flange of said top cap;

a planar spacer unit having one edge formed with a contour complementary with said contour of said struts, said contoured edge of said spacer being releasably received in said channel in said back plate of said body members; and a panel extending between and received in said side plates of said body members for forming a back wall of such shelving assembly.

* * * * *